United States Patent [19]

Takahashi

[11] 4,090,816

[45] May 23, 1978

[54] ELECTROMAGNETIC FLUID OPERATING APPARATUS

[75] Inventor: Shiro Takahashi, Tokyo, Japan

[73] Assignee: Man Design Co., Ltd., Tokyo, Japan

[21] Appl. No.: 730,655

[22] Filed: Oct. 7, 1976

[30] Foreign Application Priority Data

Oct. 14, 1975 Japan ..... 50-122942
Sep. 2, 1976 Japan ..... 51-104252

[51] Int. Cl.[2] ..... F04B 17/04; F04B 39/06; F04B 35/04

[52] U.S. Cl. ..... 417/371; 417/417

[58] Field of Search ..... 417/371, 417

[56] References Cited

U.S. PATENT DOCUMENTS 2,662,476 12/1953 French ..... 417/371 X
3,113,523 12/1963 Woodward et al. ..... 417/417

*Primary Examiner*—Carlton R. Croyle
*Assistant Examiner*—Richard E. Gluck
*Attorney, Agent, or Firm*—Ostrolenk, Faber, Gerb & Soffen

[57] ABSTRACT

In an electromagnetic fluid operating apparatus such as an air compressor in which a piston with an armature axially reciprocates along a path substantially at a right angle to the magnetic flux generated by a stator core due to alternate operation by electromagnetic attraction and mechanical repulsion, exact collimations are automatically established between the armature and the stator core and between the piston and a cylinder for the piston when they are assembled together, thereby minimizing biased frictional abrasion of coacting sliding surfaces. Provision of an internal air reservoir at the air outlet terminal effectively reduces pulsation of air supplied by the apparatus.

21 Claims, 9 Drawing Figures

ELECTROMAGNETIC FLUID OPERATING APPARATUS

BACKGROUND OF THE INVENTION

The present invention relates to an electromagnetic fluid operating apparatus, and more particularly relates to apparatus for transporting fluid such as air by piston reciprocation in which a piston with an armature axially reciprocates along a path which lies substantially at a right angle to the magnetic flux generated by a stator core due to alternate operation by electromagnetic attraction and mechanical repulsion.

In a known apparatus of the above-described type, the stator core is accompanied by induction coils connected via a half-wave rectifier to a given AC source and the armature is adapted to reciprocate axially through a magnetic space defined by a pair of confronting magnetic poles of the stator core. Further a mechanical biasing means such as a return spring is provided to return the piston to its initial position when excitation on the stator core is cancelled.

However, almost no electromagnetic fluid operating apparatuses of the above-described type have been welcomed in the practical industrial fields. The reasons for such a poor invasion of the apparatuses into actual market are estimated to be as follows.

As the armature is attracted by electromagnetic force in the direction almost normal to the direction of the line of magnetic induction generated by the stator core, the armature is liable to experience biased load caused by the line of magnetic induction. In order to successfully prevent biased frictional abrasion of coacting sliding surfaces of an apparatus, it is very important to establish highly exact collimations between the armature and the stator core and between the piston and a cylinder bearing the piston. Most of the conventional constructions for the fluid operating apparatuses cannot assure high accuracy in the above-described collimations and, thus, the most conventional fluid operating apparatuses seriously suffer from biased frictional abrasion of the coacting sliding planes, thereby shortening the life cycle thereof.

The piston reciprocates axially in the bearing cylinder at a frequency which is the same as that of the AC currency supplied to the induction coils of the stator core. As is well known, bearing systems for linear or axial reciprocal motion are not so developed as those for rotary motion. So, in order to obtain a fluid operating apparatus of high durability, it is basically necessary to provide a greatly improved bearing system for the reciprocating piston.

Intermittent intake and discharge of the air into and out of the apparatus by virtue of the piston action tends to develop pulsation of the air supplied by the apparatus. For certain uses of the air supplied by the apparatus, it is definitely required that the air supplied should be quite free of pulsation. In order to meet this requirement, it is generally employed in the prior art to insert an air reservoir tank into the connection between the apparatus and the objective to which the air is to be supplied. This leads to additional cost for provision and installation of the reservoir tank and its related parts.

The apparatus includes a number of heat emitting parts such as the induction coils, the stator core, the armature and the piston bearing system. As a result, long continuous use of the apparatus inevitably leads to extremely elevated temperatures of the entire body of the apparatus which may cause early wearing out of the mechanical and/or electrical parts, difficulty in handling of the apparatus by operators and malfunction of operational parts.

It is required that, when any operational part or parts should be replaced, the parts relating to the replacement should easily be disassembled and, after the replacement with new parts, reassembled while retaining initial high collimation between the parts coupled to each other. Constructions of most conventional fluid operating apparatuses cannot beautifully meet this requirement.

BRIEF DESCRIPTION OF THE INVENTION AND OBJECTS

It is a principal object of the present invention to provide an electromagnetic fluid operating apparatus adapted for practical use in industrial fields.

It is another object of the present invention to provide an electromagnetic fluid operating apparatus accompanied with highly exact collimation between coacting mechanical parts and with remarkably minimized biased frictional abrasion of the sliding planes.

It is another object of the present invention to provide an electromagnetic fluid operating apparatus which is by far less influenced by biased load acting on the magnetic armature in the magnetic space of the stator core.

It is a further object of the present invention to provide an electromagnetic fluid operating apparatus in which mechanical cutting can be carried out to various parts of a body such as the front casing or the stator core while retaining a single clamped state of the body, thereby remarkably enhancing collimation between cut parts on the body.

It is a still further object of the present invention to provide an electromagnetic fluid operating apparatus which can be disassembled and reassembled very easily without losing the initially established collimation between mechanical parts, thereby greatly simplifying replacement of worn-out mechanical parts.

It is a still further object of the present invention to provide an electromagnetic fluid operating apparatus capable of supplying compressed air quite free of pulsation.

It is a still further object of the present invention to provide an electromagnetic fluid operating apparatus with considerably reduced mechanical and electrical losses typically caused by overheating, mechanical and electrical parts emitting heat being cooled by air flowing through the interior of the apparatus during operation.

It is a still further object of the present invention to provide an electromagnetic fluid operating apparatus of a remarkably compact construction and lowered magnetic resistance, magnetic poles of the stator core being placed as close as possible to the running path of the piston assembly.

In accordance with the basic aspect of the present invention, a double-cylindrical front casing is coupled to the front side of the stator core and provided with an inner cylindrical front coupling extension formed integrally of and coaxially therewith and an inner cylindrical rear coupling extension formed integrally thereof and in axial alignment with said front coupling extension, means is provided for automatically collimating the front casing with the stator core when the two are coupled to each other, a front cylinder is coupled to the front coupling extension in axial alignment therewith, a rear cylinder is coupled to the rear coupling extension in axial alignment therewith, the front cylinder, rear coupling extension and rear cylinder define a path for reciprocating movement of the piston assembly in such an arrangement that a piston head is axially slidably encased within the front cylinder, a front piston extends integrally and rearwardly of the piston head, a rear piston is coupled to the front piston and axially slidably encased within the rear cylinder and the armature is clamped between the front and rear pistons, the magnetic poles are placed as close as possible to the path of movement of the piston assembly extending through the wall defining the running path of movement, a rear casing is coupled to the rear side of the stator core, a hollow front end closure is coupled to the front end of the front casing in such an arrangement as to define a cylindrical air reservoir around the front cylinder, a hollow rear end closure is coupled to the rear end of the rear casing in order to define an air intake port, and wherein mechanical biasing means is encased within the rear piston.

In a preferred embodiment of the apparatus in accordance with the present invention, the rear coupling extension of the front casing is further extended rearwardly with omission of the rear cylinder used in the basic embodiment and the rear piston is axially slidably encased in such an extended end portion of the rear coupling extension.

In the description of this specification, the side along the longitudinal axis of the apparatus closer to the piston chamber is referred to with terms "front" and "forwardly" whereas the side along the longitudinal axis of the apparatus is referred to with terms "rear" and "rearwardly".

BRIEF DESCRIPTION OF THE FIGURES

Further features and advantages of the present invention will be made clearer from the ensuing description, reference being made to the embodiments shown in the accompanying drawings, in which.

DETAILED DESCRIPTION OF THE INVENTION

Figure 1:
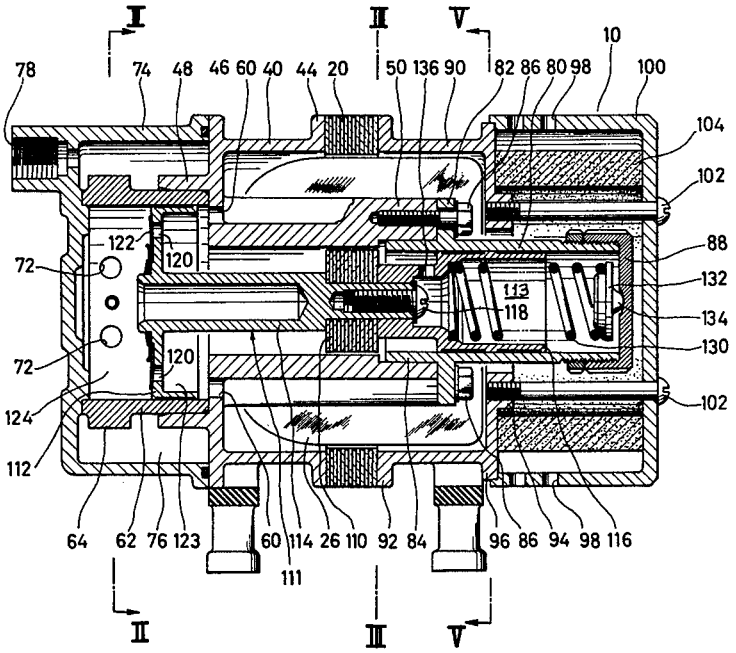
FIG. 1 is a side plan view, partly in section, of the basic embodiment of the electromagnetic fluid operating apparatus in accordance with the present invention.

An embodiment of the electromagnetic fluid operating apparatus incorporating the principles of the present invention is shown in FIGS. 1-5, in which a closed casing is formed by a cylindrical front casing 40 coupled to the front side of a stator core 20 as hereinafter described, a hollow front end closure 74 coupled to the front end of the front casing 40, a cylindrical rear casing 90 coupled to the rear side of the stator core 20 as hereinafter described and a hollow rear end closure 100 coupled to the rear end of the rear casing 90, the stator core 20 being fixedly sandwiched between the front and rear end casings 40 and 90.

Figure 4:
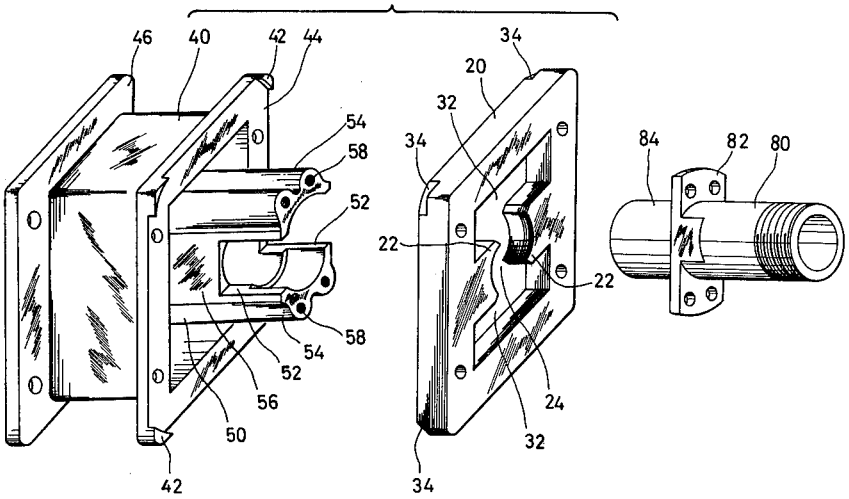
FIG. 4 is a perspective plan view of the front casing, the stator core and the rear cylinder used in the apparatus shown in FIG. 1 in a disassembled state.
Figure 3:
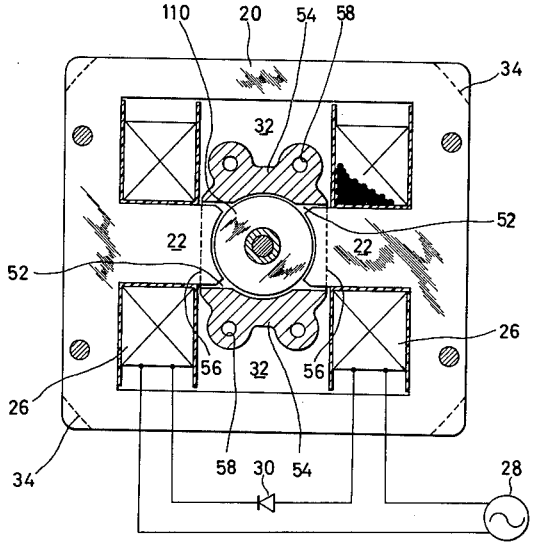
FIG. 3 is a section taken along the line III—III in FIG. 1.

As clearly shown in FIGS. 3 and 4, the stator core 20 comprises a plurality of thin silicon steel plates fixedly superposed to each other and being of an identical profile. As best seen in the drawing, each steel plate has a combined, confronting double E-shape and a pair of spacedly confronting magnetic poles 22, 22 define a magnetic space 24 between them which allows free passage of the later described magnetic armature. The stator core 20 is provided with a pair of induction coils 26, 26 which are both electrically coupled to a given AC electric source 28 via a half-wave rectifier in the form of a semiconductor element 30. The induction coils 26, 26 are so mounted to the stator core 20 that a pair of upper and lower spaces 32, 32 remain between the induction coils 26, 26. When the induction coils 26, 26 are energized, the magnetic flux developed between the magnetic poles 22, 22, thereby producing a total electromagnetic force, and the above-described magnetic armature is attracted by this electromagnetic force into a direction normal to the magnetic fluxes.

The front casing 40 is provided with a front flange 46 adapted for coupling with the front end closure 74 and a rear flange 44 adapted for coupling with the stator core 20 as hereinafter described.

The stator core 20 is provided with four notches defining seats 34 formed at each of the four corners on the front end surface thereof and arranged symmetric to each other about the center axis of the above-described magnetic space 24, i.e. the center longitudinal axis of the apparatus. In accordance with this, the front casing 40 is provided with four coupling projections 42 formed at the four corners on the rear end surface of the rear flange 44 and symmetric to each other about the center longitudinal axis of the apparatus. Thus, in the coupled state of the stator core 20 with the front casing 40, the coupling seats 34 of the former come into snug engagement with the corresponding coupling projections 42 of the latter.

The front casing 40 is further provided with a cylindrical front coupling extension 48 (FIG. 1) extending integrally and forwardly of the front flange 46 and a cylindrical rear coupling extension 50 extending integrally and forwardly of the front flange 46, the outer diameter of the rear coupling extension 50 being somewhat smaller than that of the front coupling extension 48. The above-described four coupling projections 42, the front coupling extension 48 and the rear coupling extension 50 are formed, e.g. by mechanical cutting, in coaxial relationship to each other.

A pair of cut-outs or slots 52 are formed on both sides of the rear coupling extension 50 so that the magnetic poles 22 can extend inwardly therethrough. A pair of upper and lower halves 54, 54 of the rear coupling extension 50 extend rearwardly passing through the corresponding spaces 32, 32 provided by the stator core 20.

The rear coupling extension 50 is further provided with a pair of flat surfaces 56, 56 on both sides thereof which cover the entire length thereof so that the induction coils 26 are allowed to assume positions as close to the poles of the magnetic armature as possible. By arranging the induction coils 26 very close to the magnetic armature poles, the contour of the apparatus can be remarkably minimized.

Threaded holes 58 are formed longitudinally in the rear end surface of the rear coupling extension 50 for coupling with the later described rear cylinder whereas air intakes 60 are formed through the front flange 46 of the front casing 40.

The front end closure 74 is fixed to the front end surface of the front flange 46 on front casing 40 in any known manner. A front cylinder 62 is encased within the front end closure 74 with its rear end portion being inserted into the front coupling extension 48 of the front casing 40 and its front end being carried by the inner wall of the front end closure 74. The inner diameter of the front cylinder 62 should be so designed that the above-described air intakes 60 should fairly open in the interior of the front cylinder 62.

The front cylinder 62 is provided with an outer flange 64 which provides a seat for engagement with a tool used for extracting the front cylinder 62 out of the front coupling extension 48 at the time of disassembly of the apparatus.

Figure 2:
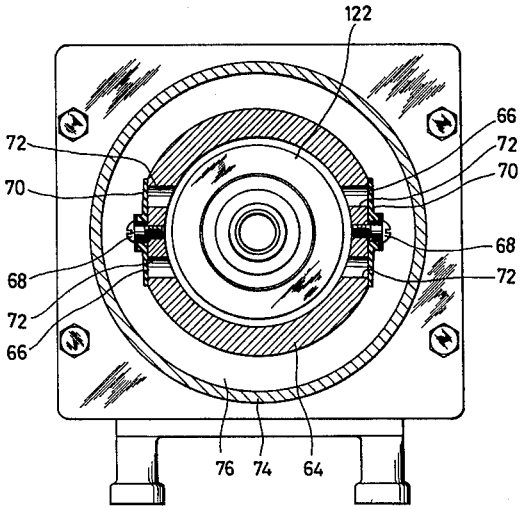
FIG. 2 is a section taken along the line II—II in FIG. 1.

As best seen in FIG. 2, the outer flange 64 of the front cylinder 62 is provided with a pair of outer flat surfaces 66 formed on both sides thereof and, in the area of the flat surfaces 66, air outlets 72, 72 are formed almost radially through the wall of the front cylinder 62. On each side, the air outlets 72, 72 are each closed by a check valve 70 fixed to each of the outer flat surfaces 66 by a screw 68. That is, the fluid is allowed to flow outwardly from the interior of the front cylinder 62 only.

A cylindrical chamber 76 defined by the inner wall of the front end closure 74 and the outer wall of the front cylinder 62 functions as a reservoir for absorbing pulsation of the compressed air and the compressed air without pulsation is discharged from the apparatus through a terminal outlet 78 opening in the cylindrical chamber 76.

Figure 5:
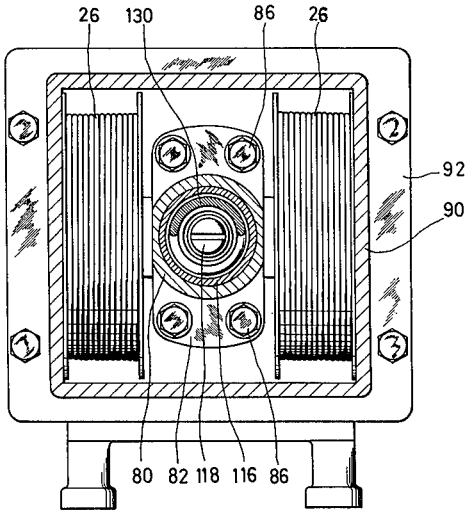
FIG. 5 is a section taken along the line V—V in FIG. 1.

A rear cylinder 80 is provided with an outer flange 82 and a cylindrical front coupling extension 84 which extends integrally and forwardly of the outer flange 82. In the assembled stator, the front coupling extension 84 of rear cylinder 80 is inserted into the rear coupling extension 50 of front casing 40 and the front end surface of the outer flange 82 on rear cylinder 80 is in abutment against the rear end surface of the rear coupling extension, while being fastened by set screws 86 as shown in FIGS. 1 and 5. An end cap 88 is disposed to the rear end of the rear cylinder 80 via threaded engagement. This end cap 88 provides a support for the seat for the later described return spring.

It is one of the very characteristic features of the present invention that the front and rear cylinders 62 and 80 are both coupled, in one body, to the front casing 40, the former via the front coupling extension 48 and the latter via the rear coupling extension 50. As already explained, the front casing 40 is coupled, in a fine and exact collimation, to the stator core 20 via the engagement of the coupling projections 42 with the coupling seats 34 and the front casing 40 is formed in a fine and exact coaxial relationship to the front and rear coupling extensions 48 and 50. Hence, the front and rear cylinders 62 and 80, when coupled to the front casing 40, can be quite automatically placed into fine and exact collimation with the magnetic space 24 of the stator core 20.

In the above-described construction, it is preferred to accompany the set screws 86, which fixes the rear cylinder 80 to the rear coupling extension 50 of the front casing 40, with suitable electric insulators in order to electrically insulate the rear cylinder 80 from the other parts of the apparatus. By this insulation, it is possible to successfully prevent harmful influence to be otherwise caused by generation of electric current otherwise resulting from such interlinkage. In this connection, it is employable also that a known hard alumite treatment should be applied to the rear cylinder 80 itself.

The rear casing 90 is provided with an outer front flange 92 which is fixed via suitable set screws (not shown) to the stator core 20 together with the rear flange 44 of the front casing 40. The rear casing 90 is further provided at the rear end thereof with an inner rear flange 94 and an outer rear flange 96. The rear end closure 100 is snugly coupled to the outer flange 96 via set screws 102 screwed into the inner flange 94. The rear end closure 100 is provided with a plurality of radially aligned air intakes 98. A cylindrical porous filter 104 is coaxially aligned with and encased within the rear end closure 100 in order to remove impurities from the air taken in through the air intakes 98.

A piston assembly 111 includes a piston head 112 slidably reciprocal in the axial direction in the front cylinder 62, a front piston 114 extending integrally and rearwardly of the piston head 112, a rear piston 116 slidably reciprocal in the axial direction in the rear cylinder 80 and fixed in axial alignment to the front cylinder 62 via a set screw 118 and an armature 110 fixedly clamped between the front and rear pistons 112 and 116. That is, the front piston 112, the armature 110 and the rear piston 116 are fixedly coupled to form one body by the set screw 118.

The piston head 112 is provided with air intakes 120 formed through the front end wall thereof and check valves 122 are attached thereto so that the air is allowed to flow from the rear side to the front side only. In the disposition shown in FIG. 1, a front piston chamber 124 is defined on the front side of the piston head 112 by the front cylinder 62 and the front end closure 74. Namely, the air is allowed to flow into the piston chamber 124 only.

Thus, the air taken into the apparatus through the air intakes 98 of the rear end closure 100 is initially filtered and hence cleaned by the porous filter 104 and then flows towards the air intakes 60 of the front flange 46 of the front casing 40.

During this process, the air flows through the space surrounding the rear cylinder 80, the space between the stator core 20 and the armature 110 and spaces surrounding the induction coils 26, 26 so as to cool these mechanical parts. After passing through the air intakes 60, the air is brought into a rear piston chamber 123 rearwardly of the piston head 112 and, when the piston assembly 111 moves rearwardly, is allowed to flow into the front piston chamber 124 through the air intakes 120. As the piston assembly 111 moves forwardly, the air prevailing in the front piston chamber 124 is forced to flow into the cylindrical chamber 76 via the air outlets 72 and further outside the apparatus through the terminal outlet 78.

A spring seat 132 is encased within the rear cylinder 80 and bears on the inner wall of the end cap 88 via a rolling contact 134 and a return compression spring 130 is inserted between a seat formed in a rear end cavity 113 of the rear piston 116 and the spring seat 132. The spring 130 urges the piston assembly 111 in the axial direction while allowing the axial turning of same. A radial through-hole 136 is formed opening in the rear end cavity 113 so that the air prevailing in the cavity 113 can escape therethrough when compressed.

The apparatus having the above-described construction operates as follows:

When the stator core 20 is excited, the armature 110 of the piston assembly 111 is attracted by the electromagnetic force generated by the stator core 20 and assumes the disposition shown in FIG. 1 while overcoming the repulsive force exerted on the piston by the return spring 130. As the excitation on the statore core 20 is removed, the piston assembly 111 is urged for forward movement due to the repulsive force of the now compressed return spring 130. By this reciprocal movement of the piston assembly 111, the air in the front piston chamber 124 is compressed and decompressed alternately.

In more detail, when the piston assembly 111 moves rearwardly towards the position shown in FIG. 1, the check valves 122 disposed upon the piston head 112 open towards the front piston chamber 124 and the air, which is taken into the rear piston chamber 123 via the air intakes 98, the filter 104 and the air intakes 60, flows into the front piston chamber 124 via the air intakes 120. As the excitation on the stator core 20 is cancelled and the piston assembly 111 is moved forwardly due to the repulsive force of return spring 130, the air prevailing in the front piston chamber 124 is compressed and the check valves 70 (see FIG. 2) covering openings 72 are opened in order to allow the air to flow into the cylindrical chamber 76 from the front piston chamber 124 via the air outlet. The air thus introduced into the cylindrical chamber 76 is then discharged therefrom via the terminal outlet 78 and supplied to a utilization device (not shown) to which the apparatus of the present invention is connected.

Figure 6:
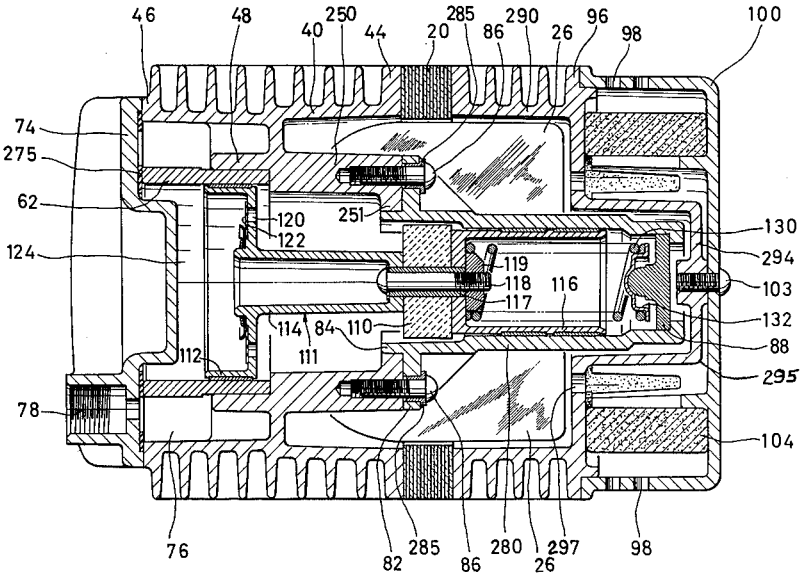
FIG. 6 is a side plan view, partly in section, of the modified embodiment of the electromagnetic fluid operating apparatus in accordance with the present invention.
Figure 7:
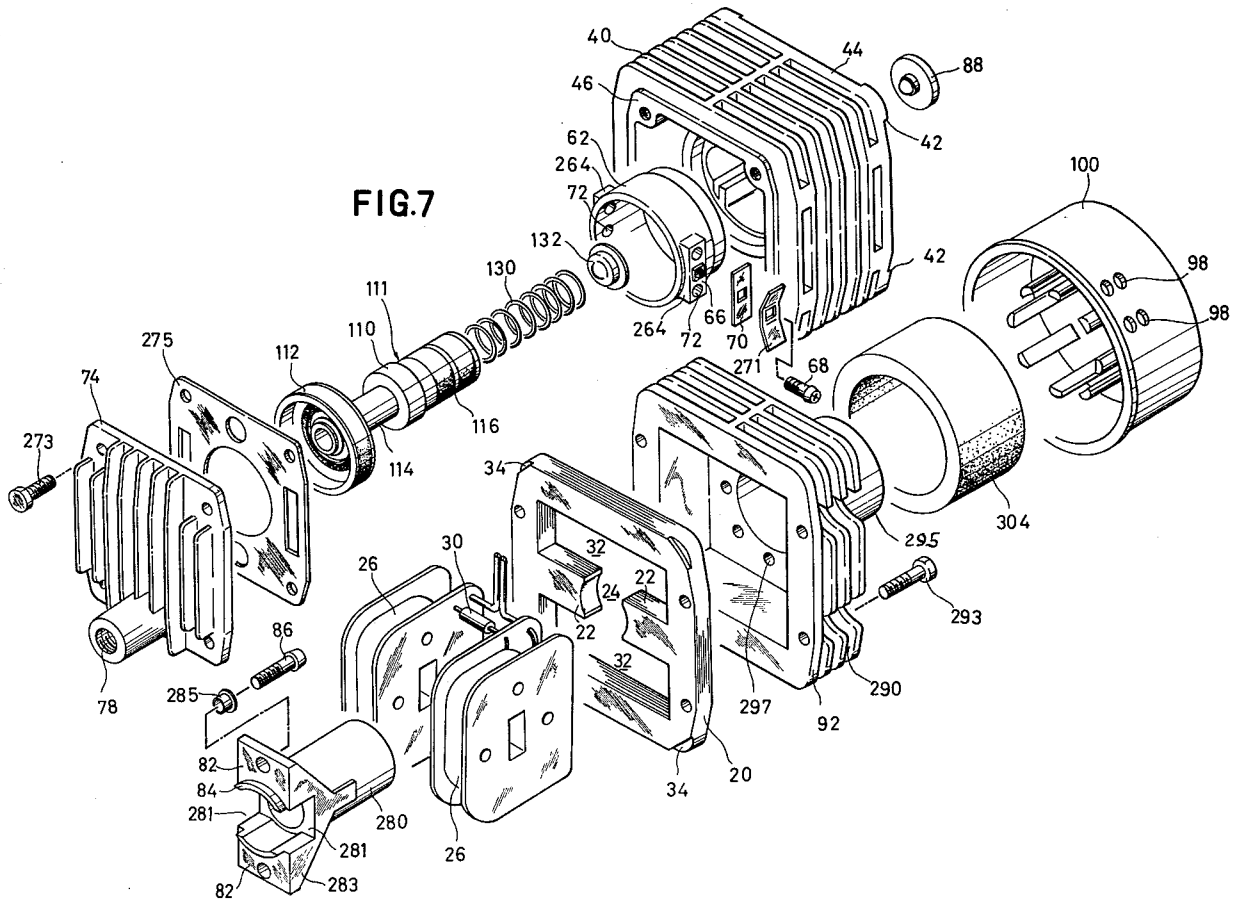
FIG. 7 is a perspective plan view of mechanical parts used in the apparatus shown in FIG. 6 in disassembled state.

Another embodiment of the electromagnetic fluid operating apparatus in accordance with the present invention is shown in FIGS. 6 and 7, in which mechanical parts substantially similar in their construction and function to the corresponding ones used in the foregoing embodiment are designated with similar reference numerals. The following explanation is thus limited to constructions different from those in the foregoing embodiment.

The hollow front end closure 74 is fixed to the front flange 46 of the front casing 40 via set screw 273 while sandwiching a packing 275 between the two. As shown in FIG. 7, the front cylinder 62 is provided with a pair of outer projections 264, 264 which provide a seat for engagement with a tool used for extracting the front cylinder 62 from the front coupling extension 48 at the time of disassembly of the apparatus. An outer flat surface 66 is formed on each of the projections 264 and an air outlet 72 radially formed therethrough is closed by a check valve 70. The check valve 70 is accompanied by a control plate 271 for limiting the extent of opening of the check valve 70.

The rear end surface of the rear coupling extension 250 is flush with that of the rear flange 44 of the front casing 40. Further, the rear coupling extension 250 is provided with an inner rear flange 251 formed at the rear end thereof. The rear cylinder 280 is coupled in axial alignment to the front casing 40 in such a way that the outer flange 82 of the rear cylinder 280 is fixed to the rear flange 251 of the rear coupling extension 250 by set screws 86 each of which is peripherally covered with an electric insulator ring 285 in the area of the outer flange 82 of the rear cylinder 280. By provision of the insulator rings 285, the rear cylinder 280 can be electrically insulated from the other parts of the apparatus. This insulation successfully prevents any harmful influence to be otherwise caused by generation of electric currency which would otherwise result from interlinkage. As a substitute for the insulator rings 285, it is employable also that a known hard alumite treatment should be applied to the rear cylinder 280 itself.

It will be well understood from the foregoing explanation that the rear coupling extension 50 in the first described embodiment of FIGS. 1–4 extends rearwardly beyond the position of the stator core 20 whereas the rear coupling extension 250 in the embodiment of FIGS. 6 and 7 terminate at a position corresponding to the front end surface of the stator core 20. Likewise, the rear cylinder 80 in the first described embodiment terminates at a position somewhat rearwardly of the rear end surface of the stator core 20 whereas the rear cylinder 280 in the present embodiment extends forwardly beyond the position of the stator core 20. However, both embodiments are quite common to each other in that the front cylinder 62, the front casing 40 and rear cylinder 80 (or 280) are coupled to form one unified body with the individual members being in axial alignment with each other.

As shown in FIG. 7, the rear cylinder 280 is provided on both sides thereof with a pair of flat surfaces 283, 283 and a pair of cut-outs or slots 281, 281 formed therethrough. The cut-outs 281 and the flat surfaces 283 correspond to the cut-outs 52 and the flat surfaces 54 formed on the rear coupling extension 50 in the first described embodiment, respectively. The magnetic poles 22 of the stator core 20 are positioned within the corresponding cut-outs 281 of the rear cylinder 280.

A rear casing 290 is coupled to the rear side of the stator core 20. That is, the front flange 92 of the rear casing 290 is fixed to the stator core 20 together with the rear flange 44 of the front casing 40 via set screws 293. The outer rear flange 96 of the rear casing 290 is accompanied with a hollow rear extension 295 and the rear end closure 100 is fixed to the rear casing 290 via a set screw 103 screwed into the center part of the rear wall of the rear extension 295. Air intakes 297 are formed through the annular wall connecting the outer rear flange 96 with the rear extension 295.

In the construction of the piston assembly 111, the front and rear piston members 114 and 116 are coupled in axial alignment to form a unified body by the set screw 118, a guide sleeve 117 and a nut 119.

The operation of the apparatus of the present embodiment is almost similar to that of the foregoing embodiment. The alternating drive by the electromagnetic force provided by the stator core 20 and the repulsive force provided by the return spring 130 causes reciprocal movement of the piston assembly 111 in the axial direction of the apparatus, thereby supplying the compressed air to a load (not shown) to which the apparatus is connected, via the terminal outlet 78.

In the case of the foregoing embodiments, collimation between the front casing 40 and the stator core 20 is obtained due to the engagement between the coupling projections 42 formed on the front casing 40 and the coupling seats 34 formed on the stator core 20. However, in a modified embodiment of the present invention, the coupling seats may be provided on the front casing and the coupling projections may be provided on the stator core.

Figure 8:
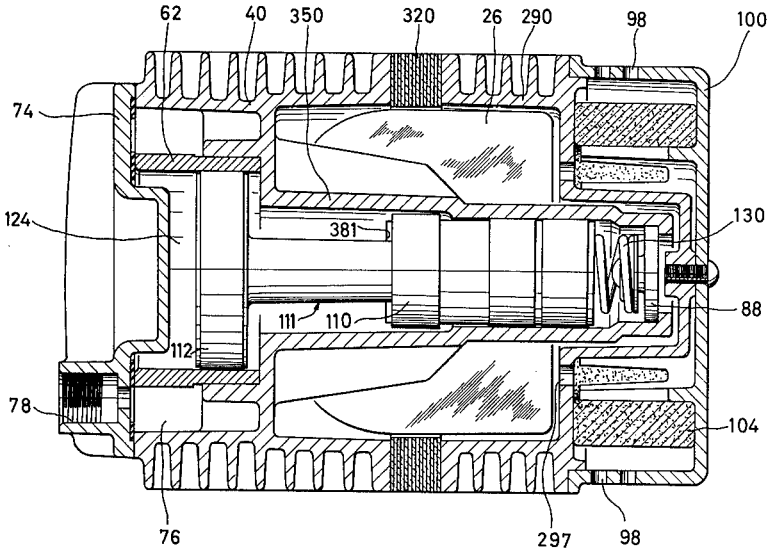
FIG. 8 is a side plan view, partly in section, of a further modified embodiment of the electromagnetic fluid operating apparatus in accordance with the present invention.

In the foregoing embodiments further, the rear coupling extension 50 (250) of the front casing 40 and the rear cylinder 80 (280) are formed as separate bodies coupled to each other by the set screws. In a further preferred embodiment of the present invention shown in FIGS. 8 and 9, the rear coupling extension 350 of the front casing 40 may be further extended rearwardly than that shown in FIG. 1 with omission of the rear cylinder 80. In other words, the rear coupling extension 50 and the rear cylinder 80 in FIG. 1 are integral parts of one unified body in the embodiment shown in FIGS. 8 and 9.

In order to enable the magnetic poles of the stator core to extend close to the running path of the piston assembly 111 through cut-outs 381 while employing the above-described elongated construction of the rear coupling extension 350, the stator core 320 in this embodiment is comprised of a pair of core halves **320*a* and 320*b*** coupled to each other.

Figure 9:
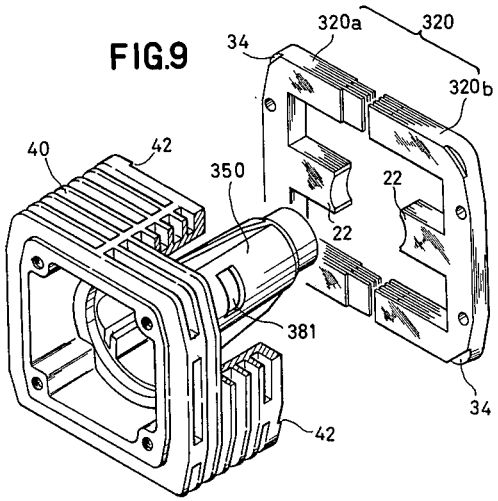
FIG. 9 is a perspective plan view of the stator core and its related parts used in the apparatus shown in FIG. 8.

The core halves **320*a* and 320*b* are of substantially similar shape and each of them is made up of a plurality of thin silicon steel plates fixedly superposed to each other. As best seen in FIG. 9, the core halves 320*a* and 320*b* are coupled to each other at mating ends of their outer branches on both sides of the intermediate branches forming the magnetic cores. In each core half, steel plates having longer outer branches and steel plates having shorter outer branches are superposed alternately so that slits are formed between pairs of steel plates having the longer outer branches and each pair sandwiching a steel plate having the shorter outer branches. When core halves 320*a* and 320*b* are coupled to eadh other, mating ends of longer outer branches of one core half are snugly received in and fused to the corresponding slits defined by longer outer branches of the other core half, the magnetic poles 22 being inserted into the cut-outs 381. Similar to the stator cores 20 used in the foregoing embodiments, the stator core 320 of this embodiment in the assembled stator is provided with coupling seats 34 on the mating surface thereof with the rear end surface of the front casing 40. The entire front casing 40** in this embodiment should preferably be subjected to a suitable treatment for provision of electric insulation in order to avoid generation of electric current otherwise caused by interlinkage.

The following advantages are obtained from employment of the present invention in the construction of the electromagnetic fluid operating apparatus.

(a) As an exact collimation is established between the stator core 20 and the front casing 40 by engagement of the coupling seats 34 with the coupling projections 42 and the front and rear cylinders 62 and 80 (280) are both coupled to the front casing 40, the armature 110 of the piston assembly 111 can always be in exact axial alignment with the magnetic space 24 formed by the stator core 20. That is, no biased load by magnetic fluxes acts on the armature 110. Therefore, undesirable frictional abrasions on sliding surfaces of the front and rear cylinders 62 and 80 (280) and the piston assembly 111 can be remarkably minimized.

(b) The piston assembly 111 carrying the armature 110 is carried stably on both longitudinal end portions. That is, the front side piston head 112 is slidably accommodated in the front cylinder 62 whereas the rear piston 116 is slidably received in the rear cylinder 80 (280), both cylinders 62 and 80 (280) being coupled in correct axial alignment with the front casing 40. Therefore, even when any biased load caused by the magnetic fluxes acts on the armature 110, frictional abrasions on sliding surfaces of the front and rear cylinders 62 and 80 (280) can be remarkably reduced.

(c) Collimation between the mechanical parts can further be enhanced due to the fact that during fabrication mechanical cutting can be applied to various parts of a body maintained in a single clamped condition. For example, in manufacturing of the stator core 20 shown in FIG. 4, the silica steel plates in the superposed state may be clamped by a jig on a lathe and cutting may be applied thereto in order to form the magnetic space 24. Next, cutting may be applied thereto again, while maintaining the clamped state, in order to form the coupling seats 34. Thus, an exact coaxial relationship is established between the magnetic space 24 and the coupling seats 34. The same techniques may be applied to manufacturing of the front casing 40. For example, the material block may be clamped by a jig on a lathe and cutting may be applied thereto in order to form the center hole of the rear coupling extension 50 (250). Next, cutting may be applied thereto again, while maintaining the clamped state, in order to form the coupling projections 42. Thus, an exact coaxial relationship is established between the rear coupling extension 50 (250) and the coupling projections 42. Further, in the case of the second embodiment, in the same way, the rear end surface of the rear flange 44 is made exactly flush with the rear end surface of the inner rear flange 251 of the rear coupling extension 250.

(d) As the rear cylinder 80 (280) is electrically insulated from other mechanical parts of the apparatus, loss in the electromagnetic efficiency, which is otherwise caused by generation of electric currency resulted from interlinkage, can be fully avoided.

(e) The piston assembly 111 is comprised of the front and rear pistons 114 and 116 which can easily be disassembled from each other and the front and rear cylinders 62 and 80 (280) can easily be disassembled from the front casing 40. So, when any frictional abrasion or wearing starts on a sliding surface of any of the above-mentioned mechanical parts, reparation can be completed merely by replacing the abrased mechanical part. In this maintenance work, the front cylinder 62 and the piston assembly 111 can be taken out of the apparatus merely by detaching only the front end closure. Whereas, the rear cylinder 80 (280) can be taken out of the apparatus by merely detaching only the rear end closure 100. Even when the front casing 40 is detached from the apparatus for any reason, reassembly of the apparatus can be carried out in a simple manner, which retaining exact axial collimation between the mechanical parts, due to the provision of the coupling seats 34 and projections 42.

(f) As the cylindrical chamber 76 operating as an air reservoir is formed in the apparatus surrounding the front cylinder 62, the air discharged out of the front piston chamber 124 is initially stored in this reservoir, thereby pulsation of the air to be supplied from the apparatus being sufficiently minimized in the reservoir even without provision of any separate reservoir tank.

(g) As the frest air introduced into the apparatus via the rear side air intakes 98 is conducted towards the front piston chamber 124 while contacting heat emitting mechanical parts such as the stator core 20, the induction coils 26 etc., pneumatic flow caused by reciprocation of the piston assembly 111 effectively cools these heat emitting parts, thereby minimizing mechanical and electric losses which are otherwise caused by overheating of the mechanical parts.

(h) As the magnetic poles 22 are positioned as close as to the running path of the armature as possible, the stator core 20 can be designed to be very compact and, therefore, the entire size of the apparatus can be made very compact, too. This also contributes to remarkable reduction in the magnetic resistance.

What is claimed is:

1. An electromagnetic fluid operating apparatus in which an armature (110) forming one unified body assembly with a piston assembly (111) moves rearwardly in a direction substantially at a right angle to the magnetic flux generated in the region between a spaced pair of confronting magnetic poles (22) of a stator core (20) having induction coils connected via a half-wave rectifier to a given AC source due to electromagnetic attraction and moves forwardly under the influence of a mechanical biasing means; characterized in that:

a double-cylindrical front casing (40) comprising inner and outer cylinders has the outer cylinder coupled to the front side of said stator core and the cylinder has a cylindrical front coupling extension (48) formed integrally thereof and coaxially therewith and an inner cylindrical rear coupling extension (50) formed integrally thereof and in axial alignment with said front coupling extension;

means for automatically collimating said front casing with said stator core when the two are coupled to each other;

a front cylinder (62) coupled to said front coupling extension in axial alignment therewith;

a rear cylinder (80) coupled to said rear coupling extension in axial alignment therewith;

said front cylinder, rear coupling extension and rear cylinder define a guiding path for reciprocation of said piston assembly, a piston head (112) axially slidably encased within said front cylinder, a front piston (114) extending integrally and rearwardly of said piston head, a rear piston (116) coupled to said front piston and axially slidably encased within said rear cylinder and said armature (110) is clamped between said front and rear pistons;

said magnetic poles (22) being placed as close as possible to said guiding path of said piston assembly extending through the wall defining said guiding path, a rear casing (90) coupled to the rear side of said stator core;

a hollow front end closure (74) coupled to the front end of said front casing defining a cylindrical air reservoir (76) around said front cylinder, said hollow front end closure (74) also defining an air outlet port;

a hollow rear end closure (100) coupled to the rear end of said rear casing in order to define an air intake port;

valve means for permitting air to flow through said electromagnetic fluid operating apparatus from said air intake port to said air outlet port but preventing air flow from said air outlet port to said air inlet port; and said mechanical biasing means extending into said rear piston.

2. An apparatus as claimed in claim 1 characterized in that said rear cylinder (80) is electrically insulated from other mechanical parts of said apparatus.

3. An apparatus as claimed in claim 2 characterized in that hard alumite treatment is applied to said rear cylinder (80).

4. An apparatus as claimed in claim 2 characterized in that said rear cylinder (80, 280) is coupled to said rear coupling extension (50, 250) via set screws accompanied by electric insulator rings (285).

5. An apparatus as claimed in claim 1 characterized in that said automatic collimating means includes coupling seats symmetrically formed on the mating surface of one of said front casing and said stator core and coupling projections symmetrically formed on the mating surface of the other of the two at positions corresponding to those of said coupling seats.

6. An apparatus as claimed in claim 5 characterized in that said coupling seats are formed on the front end surface of said stator core and said coupling projections are formed on the rear end surface of said front casing.

7. An apparatus as claimed in claim 5 characterized in that said coupling seats are formed on the rear end surface of said front casing and said coupling projections are formed on the front end surface of said stator core.

8. An apparatus as claimed in claim 1 characterized in that a cylindrical porous filter (104) is substantially coaxially encased within said rear end closure in such an arrangement that fresh air taken into said air intake port passes through said filter.

9. An apparatus as claimed in claim 1 characterized in that said air intake port is in communication with a space defined by said front and rear casings and contains said induction coils.

10. An apparatus as claimed in claim 1 characterized in that said mechanical biasing means is a coil compression spring (130) one end of which abuts against said rear piston and the other end of which abuts against the rear end wall of said cylinder.

11. An apparatus as claimed in claim 1 characterized in that said piston head (112) separates the interior of said front cylinder into a front and a rear piston chamber (124, 123) communicatable with each other via check valves provided on said piston head.

12. An apparatus as claimed in claim 11 wherein said valve means comprises check valves disposed on said front cylinder, said check valves permitting said front piston chamber (124) to communicate with said air reservoir.

13. An apparatus as claimed in claim 1 characterized in that said rear coupling extension (50) extends rearwardly beyond the longitudinal mounting position of said stator core.

14. An apparatus as claimed in claim 13 characterized in that said rear coupling extension (50) is provided on both sides with flat surfaces (56) and a pair of side cutouts (52) formed through said flat surfaces in order to allow said magnetic poles to extend closely towards said guiding path of said piston assembly therethrough.

15. An apparatus as claimed in claim 1 characterized in that the rear end surface of said rear coupling extension (250) is flush with the mating surface of said front casing with said stator core.

16. An apparatus as claimed in claim 15 characterized in that said rear cylinder (280) is provided on both sides with flat surfaces (283) and a pair of side cut-outs (281) formed through said flat surfaces in order to allow said magnetic poles to extend closely towards said guiding path of said piston assembly passing therethrough.

17. An electromagnetic fluid operating apparatus in which an armature (110) formed as one unified body with a piston assembly (111) moves rearwardly along a path arranged substantially at a right angle to the magnetic flux generated between a pair of confronting magnetic poles (22) of a stator core (20) accompanied with induction coils connected via a half-wave rectifier to a given AC source due to electromagnetic attraction and moves forwardly under the influence of a mechanical biasing means; characterized in that:

a double-cylindrical front casing (40) comprising inner and outer cylinders, wherein the outer cylinder is coupled to the front side of said stator core and the inner cylinder is provided with an inner cylindrical front coupling extension (48) formed integrally of and coaxially therewith and an inner cylindrical rear coupling extension (50) formed integrally thereof and in axial alignment with said front coupling extension;

means for automatically collimating said front casing with said stator core when the two are coupled to each other;

a front cylinder (62) being coupled to said front coupling extension in axial alignment therewith;

said front cylinder and said rear coupling extension defining a guiding path for reciprocation of said piston assembly, a piston head (112) axially slidably encased within said front cylinder, a front piston (114) extending integrally and rearwardly of said piston head, a rear piston (116) coupled to said front piston and axially slidably encased within the rear end portion of said rear coupling extension and said armature (110) being clamped between said front and rear pistons;

said magnetic poles (22) being placed as close as possible to said running path of said piston assembly extending through the wall defining said running path;

a rear casing (90) coupled to the rear side of said stator core;

a hollow front end closure (74) coupled to the front end of said casing defining a cylindrical air reservoir (76) around said front cylinder, said hollow front end closure (74) also defining an air outlet port;

a hollow rear end closure (100) coupled to the rear end of said rear casing in order to define an air intake port;

valve means for permitting air to flow through said electromagnetic fluid operating apparatus from said air intake port to said air outlet port but preventing air flow from said air outlet port to said air inlet port; and said mechanical biasing means being at least partially encased within said rear piston.

18. An apparatus as claimed in claim 17 characterized in that said stator core (320) is comprised of a pair of core halves (320*a*, 320*b*) of substantially similar shape and coupled to each other at their mating ends.

19. An apparatus as claimed in claim 18 characterized in that each of said core halves is made up of a plurality of thin silicon steel plates fixedly superposed to each other, steel plates having longer outer branches and steel plates having shorter outer branches are superposed alternately in order to form slits between pairs of steel plates having said longer outer branches and each pair sandwiching a steel plate having said shorter outer branches and, in the coupled state, mating ends of longer outer branches of one core half are snugly received in and fused to said slits on the other core half.

20. The apparatus of claim 17 wherein said rear coupling extension is a cone-piece member housing said front and rear pistons and said armature; said rear coupling extension having side cut-outs for receiving the poles of said core.

21. The apparatus of claim 17 wherein said rear coupling extension is a two-piece member housing said front and rear pistons and said armature; said rear coupling extension having side cut-outs for receiving the poles of said core.

* * * * *